US008336401B2

(12) United States Patent
Gouws

(10) Patent No.: US 8,336,401 B2
(45) Date of Patent: Dec. 25, 2012

(54) DUST CATCHER AND SAMPLER FOR USE WITH A MINING DRILLING APPARATUS

(76) Inventor: Petrus Christiaan Gouws, Witbank (ZA)

( * ) Notice: Subject to any disclaimer, the term of this patent is extended or adjusted under 35 U.S.C. 154(b) by 741 days.

(21) Appl. No.: 12/374,578

(22) PCT Filed: Jul. 13, 2007

(86) PCT No.: PCT/IB2007/052806

§ 371 (c)(1),
(2), (4) Date: Oct. 15, 2009

(87) PCT Pub. No.: WO2008/010174

PCT Pub. Date: Jan. 24, 2008

(65) Prior Publication Data

US 2010/0032211 A1 Feb. 11, 2010

(30) Foreign Application Priority Data

Jul. 19, 2006 (ZA) ..... 2006/05978
Jan. 31, 2007 (ZA) ..... 2007/00913

(51) Int. Cl.
*G01N 1/20* (2006.01)

(52) U.S. Cl. ..... 73/863.53; 73/863; 73/863.01; 73/863.51; 73/864.51

(58) Field of Classification Search ..... 73/863, 73/863.01, 863.51, 863.53, 863.71, 863.81, 73/864.51
See application file for complete search history.

(56) References Cited

U.S. PATENT DOCUMENTS

| | | | | | |
|---|---|---|---|---|---|
| 1,721,126 | A | * | 7/1929 | Lilligren | 175/88 |
| 2,167,393 | A | | 7/1939 | Muncy | |
| 2,950,724 | A | * | 8/1960 | Roederer, Jr. | 73/863.23 |
| 3,070,180 | A | | 12/1962 | Norrick | |
| 3,291,229 | A | | 12/1966 | Houston | |
| 3,716,167 | A | * | 2/1973 | Huntington | 73/863.45 |
| 3,811,518 | A | | 5/1974 | Kalaf et al. | |

(Continued)

FOREIGN PATENT DOCUMENTS

| | | | |
|---|---|---|---|
| DE | 4109079 | A1 * | 10/1991 |
| JP | 03238339 | A * | 10/1991 |
| SU | 885 551 | A1 | 11/1981 |

*Primary Examiner* — David Rogers
(74) *Attorney, Agent, or Firm* — Millen, White, Zelano & Branigan, P.C.

(57) ABSTRACT

The invention relates to an accessory for a drilling apparatus for drilling holes into the ground and into which explosives can be filled for blasting purposes. Such drilling commonly occurs in open cast mining for mining of mineral deposits. It is known to take samples from materials blown from holes during drilling, permitting analysis of the samples in order to estimate accurately the mineral content in the area being mined. The accessory is operatively supported on a drilling apparatus and includes a dust particle catcher, for catching dust particles blown from a hole to form dust particle samples, and a collection arrangement including receptacles in which dust particle samples are collected. A control arrangement of the accessory controls the operation thereof and serves also to enable the hole and the depth region of the hole, from which each sample was collected, to be identified.

24 Claims, 5 Drawing Sheets

U.S. PATENT DOCUMENTS 3,901,332 A * 8/1975 Ebner et al. ..... 175/209
3,924,696 A * 12/1975 Horlin et al. ..... 175/209
4,223,748 A * 9/1980 Barendsen ..... 175/66
4,276,778 A * 7/1981 Ham ..... 73/864.43
4,650,013 A 3/1987 Hoeft
5,054,327 A * 10/1991 Gould ..... 73/863
6,119,531 A * 9/2000 Wendte et al. ..... 73/863.52
6,138,522 A * 10/2000 Miyoshi ..... 73/864.43
6,386,026 B1 5/2002 Zamfes
6,845,657 B2 * 1/2005 Williams ..... 73/152.23
2006/0236786 A1 * 10/2006 Burton ..... 73/863
2008/0105062 A1 * 5/2008 Lennox Day ..... 73/863

* cited by examiner

DUST CATCHER AND SAMPLER FOR USE WITH A MINING DRILLING APPARATUS

THIS INVENTION relates to drilling apparatus for use in mining.

The invention relates particularly to an accessory for such a drilling apparatus and, as such, to a drilling apparatus adapted to accommodate such an accessory and to a drilling apparatus that includes such an accessory as part thereof.

A drilling apparatus for use in mining and as herein envisaged constitutes an apparatus such as the apparatus commonly used in open cast mining, and the like, particularly for drilling holes in the ground into which explosives can be filled for blasting purposes, although holes can be so drilled for other purposes also. Open cast mining provides for mining of mineral deposits, such as iron ore, coal, platinum, and the like, from above the ground surface. The mineral deposits usually are found in seams in the ground, at and beneath the ground surface and usually between rock layers, blasting providing for fragmenting of the ground, which in turn permits removal of the fragmented ground and hence separation of the minerals from the remainder of the ground by various known separation processes.

The general configuration of and the operation of a drilling apparatus of the type herein envisaged are already well known and these aspects are not described further herein, except insofar as it is required for purposes of defining, explaining and clarifying the present invention. As such, a typical drilling apparatus of the type herein envisaged includes a support structure whereby the apparatus is supported on a ground surface where a hole must be drilled into the ground. The support structure includes a deck above which the drill body and the drill motor of the drilling apparatus are supported, the drill bit for drilling into the ground being engaged with a drill chuck of the drill body and extending from the chuck through a hole defined therefor in the deck. A bearing-type seal acts between the drill bit and the deck for preventing dust particles, blown from a hole being drilled, to pass through the hole in the deck.

The drill bit used in conjunction with the drilling apparatus defines a passage therethrough through which pressurized air for cooling the drill bit is displaced during drilling, the air serving also to displace dust particles, formed by a drill bit when drilling a hole, from the hole, the dust particles conventionally being blown from the hole towards and against the deck and then dropping onto the ground surface adjacent to the hole being drilled.

In relation to the process of drilling holes in the ground, as occurs in open cast mining when an area to be blasted has a series of holes drilled therein for receiving explosives, it is known to take samples of dust particles blown from holes being drilled at different drilling depths. The samples can then be analyzed in order to be able to generate an accurate estimate of the mineral content of the ground in the area being drilled.

The taking of ground samples conventionally is a manual operation which includes "catching" dust particles blown from a hole being drilled in a suitable receptacle. The problem associated with this manual operation is that the linking of a ground sample to a hole depth and the location within an area in which the hole, from which a sample has been taken, has been drilled, in practice, has proven unreliable, thus not permitting an accurate estimate of mineral content within an area being drilled to be established. Insofar as the taking of ground samples as above envisaged and the process associated with the identification of samples and the analysis of samples for particular purposes are already well known, these aspects are not described further herein.

It is an object of this invention to at least alleviate the above problem that is associated with the establishment of estimates of mineral content within an area being drilled and that results from the manual operation associated with the taking of samples and the identification of samples taken.

According to the invention there is provided an accessory for use with a drilling apparatus, which includes,

- an accessory support structure that can be mounted on the support structure of a drilling apparatus in a location where it is exposed to dust particles blown from a hole drilled by the drilling apparatus, in use of the drilling apparatus;
- a dust particle catcher mounted on the accessory support structure in a configuration in which, with the accessory support structure mounted on the support structure of a drilling apparatus and during drilling of a hole, it can catch dust particles to form a dust particle sample and discharge the dust particle sample into a receptacle; and
- a control arrangement that can control the operation of the dust particle catcher for forming dust particle samples representative of depth segments of a hole being drilled by a drilling apparatus on the support structure of which the accessory support structure is operatively mounted.

The accessory support structure of the accessory of the invention may be mounted on the deck of the support structure of a drilling apparatus, to be disposed operatively beneath the deck. This clearly is a location where the accessory support structure will be exposed to dust particles blown from a hole drilled by the associated drilling apparatus, thus to enable a dust particle catcher mounted on the accessory support structure to catch dust particle samples.

The accessory support structure further may include first displacement means for displacing the position of the dust particle catcher mounted on the accessory support structure, with the accessory support structure mounted on the deck of the support structure of a drilling apparatus, between an operative configuration, in which it can catch dust particles, and an inoperative configuration, in which it is closely spaced beneath the deck of the support structure of the drilling apparatus. The control arrangement of the accessory particularly may control the operation of the first displacement means.

Insofar as it is known to associate a drilling apparatus with a particle brush arrangement that operates in the path of dust particles being blown from a hole being drilled by the drilling apparatus for displacing the dust particles horizontally away from the hole being drilled to a spaced location on the ground surface away from the hole, the location of the accessory support structure, and as such, of the dust particle catcher mounted thereon and disposed in its operative configuration, will be such that the dust particle catcher is located in the path of dust particles displaced by the brush arrangement, for catching dust particles thereon to form a dust particle sample. Clearly, where such a brush arrangement is not associated with the drilling apparatus, the accessory support structure and, as such, the dust particle catcher mounted thereon, with the dust particle catcher in its operative configuration, will be located beneath the deck of the drilling apparatus in a position in which it can catch dust particles blown from a hole against the deck and hence dropping back from the deck to the ground surface adjacent the hole being drilled.

Further according to the invention, the dust particle catcher of the accessory of the invention may include a vessel formation that is pivotally displaceable between a catching configuration, in which it can catch dust particles thereon for forming a dust particle sample, and a discharge configuration, in which a dust particle sample is displaced from the vessel formation into a receptacle. As such, the accessory may include a second displacement means for pivotally displacing the vessel formation of the dust particle catcher between its catching configuration and its discharge configuration. The control arrangement may again control the operation of the second displacement means. The configuration of the vessel formation of the dust particle catcher particularly is configured to permit dust particles forming a dust particle sample to slide therefrom under gravity into a receptacle held beneath the catcher, when disposed in its discharge configuration.

It is envisaged also that the vessel formation of the dust particle catcher may be displaceable from a first location, where it is disposed in its catching configuration and in a location where it can catch dust particles for forming a dust particle sample, and a second location displaced from the first location, where it is displaceable into its discharge configuration for discharging a dust particle sample into a receptacle. A third displacement means may be provided for displacing the vessel formation of the dust particle catcher between its first location and its second location and the control arrangement again may control the operation of the third displacement means.

The accessory of the invention further may include a receptacle carrier mounted on the accessory support structure and that is configured to carry at least one receptacle in a location where it can receive a dust particle sample caught by the dust particle catcher. The receptacle carrier preferably can removably carry a plurality of receptacles and, as such, the carrier may be displaceable with respect to the accessory support structure in a configuration in which receptacles carried thereby are alternately disposed in a position with respect to the dust particle catcher to receive a dust particle sample therefrom. According to a preferred embodiment of the invention, the receptacle carrier comprises a rotatable carousel-type structure that removably carries a plurality of receptacles that, through rotation, alternately displaces a different receptacle carried thereby into a position in which it can receive a dust particle sample therein from the dust particle catcher.

The accessory of the invention may thus include a fourth displacement means for displacing the receptacle carrier with respect to the support structure between positions in which receptacles carried thereby are alternately positioned with respect to the dust particle catcher to receive a dust particle sample therein. The control arrangement again may control the operation of the fourth displacement means.

The accessory of the invention also may include receptacles to be removably carried by the receptacle carrier and, as such, the receptacles may comprise any one of receptacle bags, bottles, and the like, that can be closed for containing dust particle samples therein.

It is particularly envisaged that the number of receptacles carried by the receptacle carrier will equal the number of dust particle samples to be taken from a particular hole being drilled in the ground, a dust particle sample, for example, being taken for each one meter depth of a hole being drilled, although this clearly can be greatly varied. The receptacle carrier thus permits the required number of dust particle samples, to be taken in respect of a hole being drilled, to be collected in receptacles carried thereby, permitting receptacles to be removed therefrom and hence being submitted for analysis.

The relationship between the dust particle catcher of the accessory of the invention and the receptacle carrier clearly can be varied for accommodating particular requirements in relation to the location where holes are to be drilled, the direction of holes being drilled, the mode of catching dust particles by the dust particle catcher and the mode of dust particle samples being discharged by the catcher. As such, although it is generally envisaged that dust particle samples will be displaced from the dust particle catcher into a receptacle under the force of gravity, it is envisaged also that the dust particle catcher may include a displacement arrangement that is operable with respect thereto for displacing a dust particle sample therefrom into a receptacle. It will be appreciated that the features of the accessory of the invention in this regard are greatly variable, as is the general configuration of the accessory of the invention, which may be adapted particularly to cooperate with a particular drilling apparatus with which the accessory of the invention can be employed.

Insofar as the control arrangement of the accessory of the invention may control the operation of the various displacement means referred to, it must be appreciated that the displacement means may be hydraulically, electrically and/or electro-mechanically operable and that the exact configuration of the accessory of the invention in this regard is greatly variable.

The control arrangement of the accessory of the invention, in use of the accessory, may be operatively linked with a programmed logic controller that is programmed to facilitate the identification of dust particle samples collected in receptacles in terms of particular holes drilled from which the samples are collected and the depth ranges of each particular hole drilled, from which samples are collected. A programmed logic controller as envisaged may form a part of the accessory of the invention.

Still further, the programmed logic controller may be operatively linked with the drilling apparatus with which the accessory of the invention is operatively associated, facilitating the operation of the accessory in terms of taking dust particle samples in response to the actual drilling of a hole in the ground. It will again be appreciated that the configuration and mode of operation of the control arrangement of the invention in this regard is greatly variable and insofar as the control arrangement is operable in conjunction with state-of-the-art equipment, this is not described in further detail herein.

The accessory of the invention still further may include sample identifier means for identifying dust particle samples taken by the accessory. The sample identifier means may be configured to utilize RFID technology, each receptacle for receiving a dust particle sample during use of the accessory carrying a RFID tag to which required information is transferred for identify the location of a hole and the depth range of the hole, from which a dust particle sample has been taken and received in the receptacle.

Alternatively, the accessory may include a RFID feeder device for feeding RFID tags into receptacles in which dust particle samples are collected, in use of the accessory, the feeder device serving also to transfer required information to the memories of the RFID tags for identifying the location of a hole being drilled and the depth segment of the hole from which a dust particle sample has been taken. Insofar as RFID technology is already well known and insofar as it can be applied in various different ways in conjunction with the accessory of the invention, the invention extends also to all such variations in relation to the use of RFID technology in conjunction with the accessory of the invention.

Insofar as a drilling apparatus may be adapted particularly for use with an accessory, in accordance with the invention, the invention extends also to such a drilling apparatus that is particularly adapted for the purpose. Still further, insofar as a drilling apparatus may include an accessory, in accordance with the invention, as part thereof, the invention extends also to such a drilling apparatus that includes an accessory, in accordance with the invention, as part thereof.

Insofar as the use of the accessory of the invention essentially is associated with a novel method of taking dust particle samples in conjunction with the drilling of holes in a ground area, the invention extends also to this method which includes, in conjunction with each dust particle sample taken, associating the dust particle sample with a RFID tag that includes information in respect of the location of the hole drilled within the area and the depth segment of the hole from which the sample has been taken.

By associating RFID tags with dust particle samples, the generation of an accurate estimate of mineral content within a ground area into which holes have been drilled is greatly facilitated. It will be appreciated that the method as above defined in relation to the use of the accessory of the invention is greatly variable.

The features of an accessory for use with a drilling apparatus, in accordance with the invention, and the use of the accessory in conjunction with a drilling apparatus in an open cast mine, are described hereafter with reference to an example of an accessory, which is illustrated in the accompanying diagrammatic drawings. In the drawings.

Figure 1:
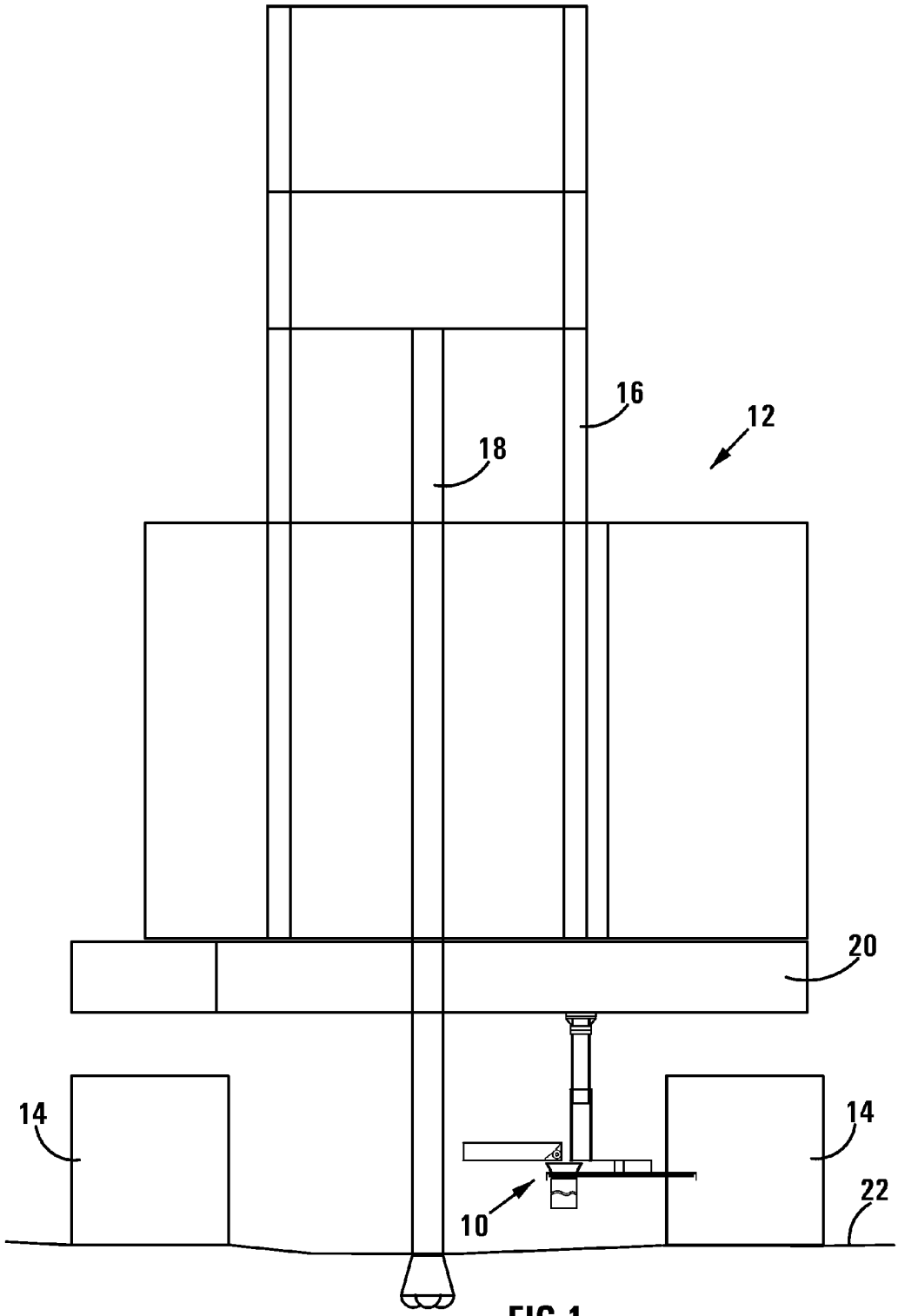
FIG. 1 illustrates schematically in end view the configuration of a drilling apparatus that has a first embodiment of an accessory for use with a drilling apparatus, in accordance with the invention, mounted thereon.
Figure 2:
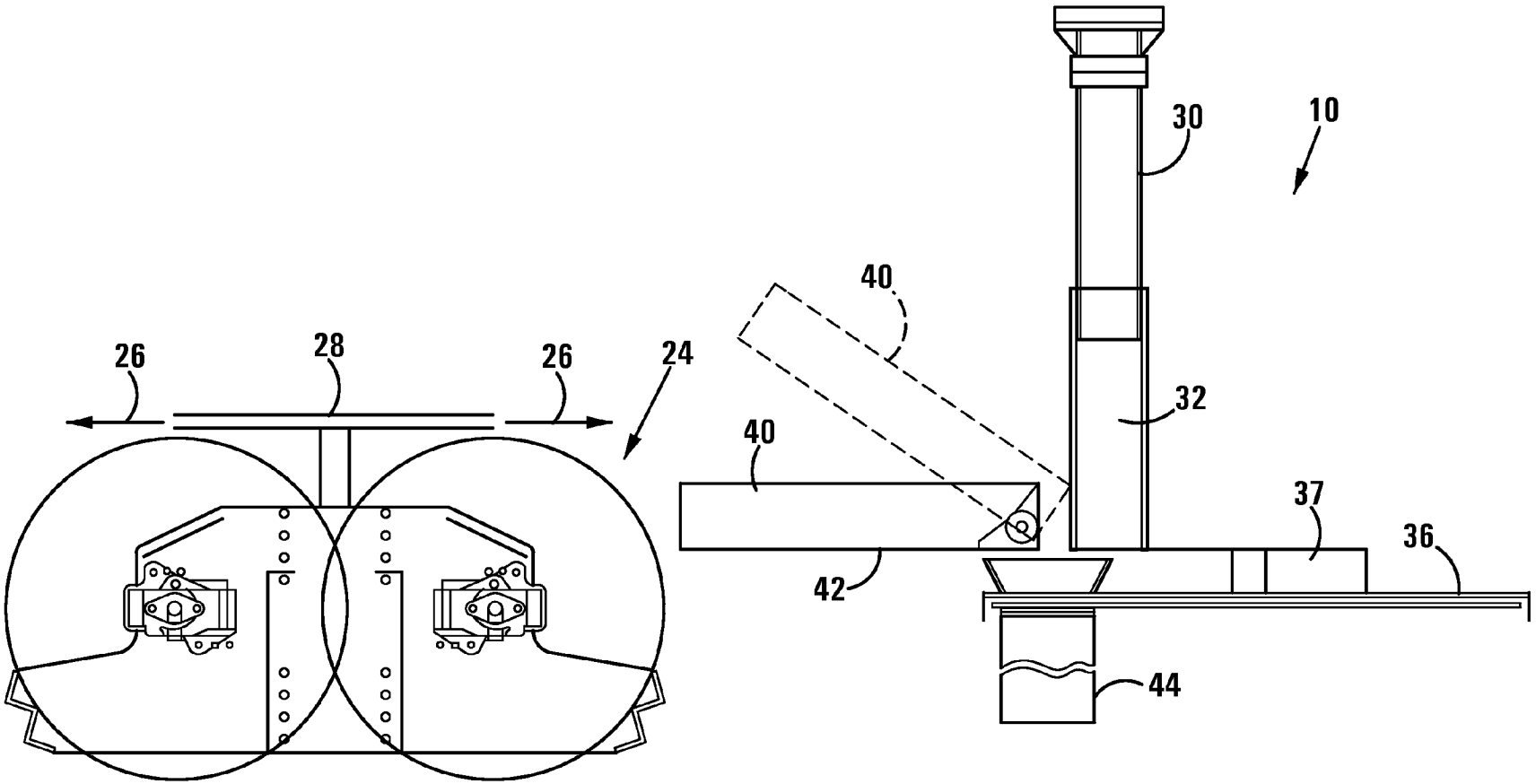
FIG. 2 illustrates schematically in end view the accessory for use with a drilling apparatus as shown in FIG. 1.
Figure 3:
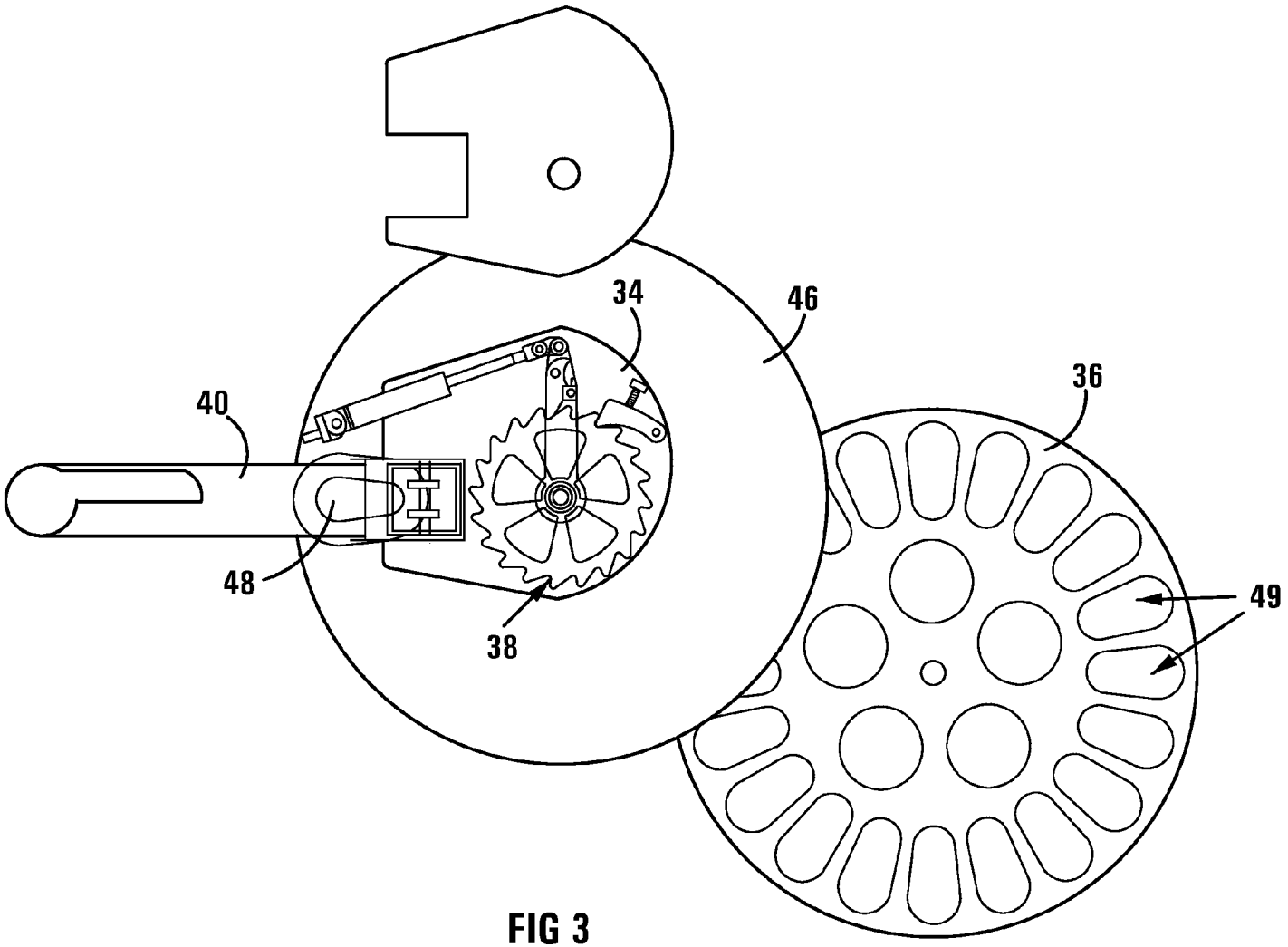
FIG. 3 illustrates schematically in exploded plan view the accessory as shown in FIG. 2.

Referring initially to FIGS. 1 to 3 of the drawings, a first embodiment of an accessory for use with a drilling apparatus, in accordance with the invention, is designed generally by the reference numeral 10, FIG. 1 illustrating the operative configuration of the accessory 10 mounted on a drilling apparatus, which is designated generally by the reference numeral 12. The drilling apparatus is displaceable on a pair of tracks 14 into required drilling locations and includes a mast 16 that serves to guide the displacement of a drill rod 18. The mast 16 forms a part of a support structure of the drilling apparatus 12, the support structure including also a deck 20 above which the drill motor and the remaining mechanical structure of the drilling apparatus 12 is supported, this being essentially conventional and not being described further herein. The drill rod 18 passes through a hole in the deck 20, a bearing-type seal (not shown) acting between the drill rod and the deck for preventing dust particles blown from a hole being drilled from passing through the hole in the deck.

For purposes of illustration, the ground surface into which a hole is to be drilled is indicated by the numeral 22, the drill bit end of the drill rod 18 being shown penetrating the ground in a location adjacent the accessory 10. The drill rod 18 particularly defines a central passage therethrough through which air is displaced under pressure to the drill bit end, this air serving a cooling function and also serving to displace dust particles generated through drilling from the hole being drilled. The dust particles are thus blown upwardly from the ground towards the deck 20 from where they again drop downwardly onto the ground.

In an alternative arrangement and as shown in FIG. 2 of the drawings, a brush arrangement 24 may be provided through which the drill rod 18 centrally passes, the brush arrangement, through rotation of the brushes thereof, serving to displace dust particles in the direction of arrows 26 when blown from a hole being drilled. The brush arrangement includes a deflector plate 28 that serves to prevent dust particles from being blown against the deck, thereby ensuring that the bearing-type seal, acting between the drill rod and the deck, is protected against wear resulting from such dust particles.

Figure 7:
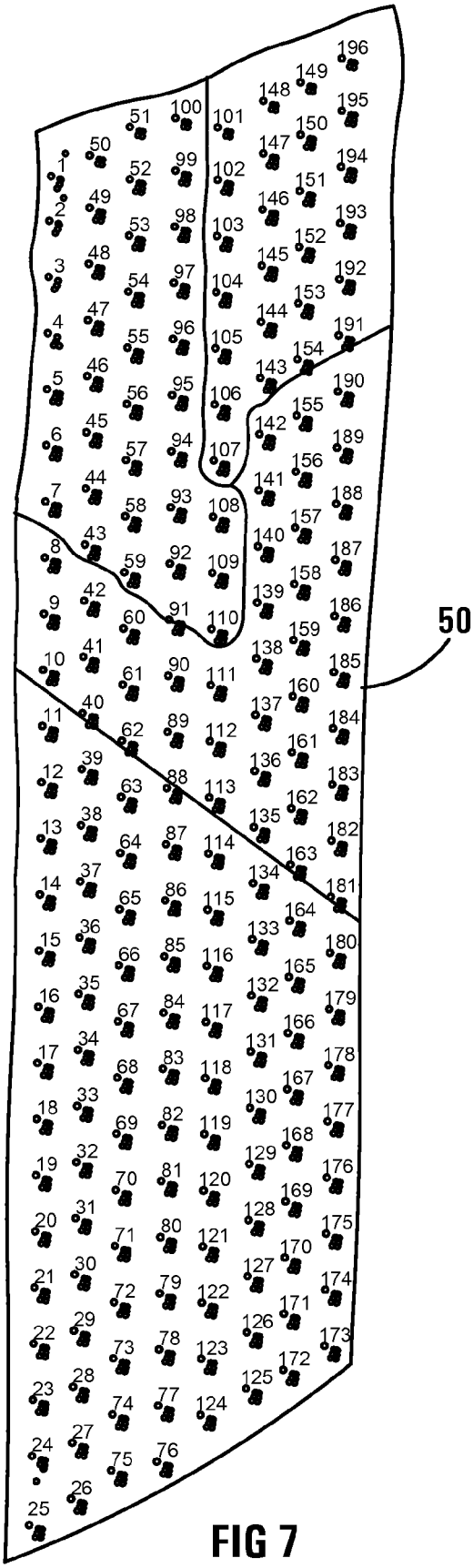
FIG. 7 illustrates schematically an application of an accessory for use with a drilling apparatus, in accordance with the invention, in conjunction with a drilling apparatus in a ground area in an open cast mining application.

As is explained in more detail hereafter with reference to FIG. 7 of the drawings, the drilling apparatus 12, in conjunction with the accessory 10, typically is used for drilling a plurality of holes in a ground area of an open cast mine, the holes serving to receive explosives therein for blasting purposes. Blasting provides for fragmenting of the ground, which permits removal of the fragmented ground and, thereafter, separation of minerals from the fragmented ground by known separation processes.

It is known in conjunction with the above application to gather ground samples, in dust particle form, from holes drilled, each individual sample being operatively linked with a hole drilled in a particular location within the ground area and also with a depth segment of the hole. The analysis of such dust particle samples hence permit the generation of an accurate estimate of the mineral content of the mineral being mined within the relevant ground area. Such an estimate is commonly required and, as explained hereafter, the accessory of the invention facilitates the taking of dust particle samples from holes being drilled.

Referring particularly to FIGS. 2 and 3 of the drawings, the accessory 10 includes a support structure 30 whereby the accessory is displaceably mounted on the deck 20 of the drilling apparatus 12, the support structure 30 including a hydraulically operated piston/cylinder mechanism 32 whereby the location of the accessory 10 with respect to the brush arrangement 24 is rendered adjustable. The support structure 30 includes also a support body 34 on which a carousel-type receptacle carrier 36 is rotatably carried, a hydraulically operated ratchet-type arrangement 38 (not described or illustrated in detail) providing for the rotation of the receptacle carrier 36 for locating receptacles carried thereby, alternately in a position in which a dust particle sample can be received therein, particularly as described hereafter.

The accessory 10 includes further a dust particle catcher 40 which comprises a pivotally mounted, partially cut-away tubular body 42, the body 42 being displaceable between an operative configuration as shown in solid lines in FIG. 2, in which it can catch dust particles thereon, and a discharge configuration as shown in dotted lines in FIG. 2, in which dust particles caught thereon can be slidably displaced under the force of gravity into a receptacle 44 carried by the receptacle carrier 36.

The tubular body 42 is operatively linked with a hydraulically operated displacement mechanism (not shown) that provides for the displacement of the body between its two configurations as described.

As is clear from FIG. 2 of the drawings, the receptacle carrier 36 is disposed beneath a plate member 46 of the support body 34, the plate member 46 defining an aperture 48 therein which, at any particular time during the operation of the accessory 10, will be in register with the open end of a receptacle 44 carried by the receptacle carrier 36. As is apparent from FIG. 3 of the drawings, the receptacle carrier 36 defines a plurality of apertures 49 therein around the perimeter thereof, each aperture 49 being operatively associated with carrier means (not shown) that removably carries a receptacle 44. Each receptacle 44 typically comprises a flexible synthetic plastics bag, or the like. It is envisaged also that the receptacle carrier 36 can removably carry a plurality of solid body containers, e.g. bottles, and the like. It will be understood that during drilling of holes, in order to take different dust particle samples, through the rotation of the receptacle carrier 36, different receptacles can be positioned in register with the opening 48 in the plate member 46, permitting dust particles to be displaced therein by the operation of the dust particle catcher 40.

Referring also to FIG. 7 of the drawings, the accessory 10 typically is used in conjunction with a drilling apparatus for drilling holes in the ground area 50 which constitutes a ground area identified for open cast mining and within which mineral deposits are present beneath the surface of the ground area 50. By fragmenting the ground covered by the area through blasting, the fragmented ground, including minerals, can be removed and the minerals can be separated from the remaining ground by a suitable separation process.

The ground area 50 typically is in the order of 250 m long and 70 m wide which, typically, requires 196 holes to be drilled therein in the locations as shown. The holes must be drilled to the depth to which the ground within the area must be fragmented, each hole receiving explosive material therein for blasting purposes. Although, in practice, a general estimate of the mineral content within the ground area 50 will have been established prior to carrying out the complete drilling operation, it is known to take dust particle samples from individual holes drilled in order to permit the analysis of such samples and hence to generate a more accurate estimate of mineral content within the area.

The use of the accessory 10 particularly facilitates this taking of dust particle samples, it being required in particular to take a plurality of dust particle samples from each hole drilled, each sample being a sample of dust particles removed from a hole segment of the hole drilled. For example, a sample may be taken from each meter length of the hole drilled. All the holes drilled within the area 50 will be drilled to the same depth, this depth being determined by mining requirements which are greatly variable, although for the purposes of this specification, the holes drilled within the area 50 are drilled to a depth of 15 m. As such, by obtaining a dust particle sample for each meter depth of each hole drilled, each hole will be associated with fifteen dust particle samples that are received in fifteen different receptacles, each receptacle of a set of fifteen receptacles thus being associated with a particular hole and with a different particular depth segment of the hole.

In order to drill a hole within the area 50, the drilling apparatus is suitably positioned, whereafter the accessory is suitably positioned with respect to the brush arrangement 24 so that dust particles displaced thereby are displaced towards the dust particle catcher.

It must be understood in this regard that the piston/cylinder mechanism 32 permits displacement of the dust particle catcher 40 and the support body 34 between an inoperative configuration, in which it is closely spaced beneath the deck 20 of the drilling apparatus 12, and an operative configuration, in which dust particles displaced by the brush arrangement 24 are displaced towards and onto the dust particle catcher 40 to form dust particle samples. For each hole to be drilled, the receptacle carrier 36 will carry 15 receptacles, a first one of these receptacles being positioned in register with the hole 48 in the plate member 46 upon the drilling operation commencing. During the first meter of drilling, dust particles blown from the hole being drilled and displaced by the brush arrangement 24 will be caught on the dust particle catcher 42, dust particles so caught being displaced into the receptacle by displacement of the catcher from its operative configuration into its discharge configuration, which may occur either a single time for a complete meter drilled, or a number of times. As the second meter of drilling is initiated, the receptacle carrier 36 will be rotated to a position in which a second one of the receptacles carried thereby is in register with the hole 48, thus receiving dust particles therein which are formed by the drill bit as a result of drilling the second meter depth of the hole. This process will repeat itself for each one meter depth hole drilled, fifteen receptacles thus having dust particle samples received therein upon completion of the hole. While the drilling apparatus, including the accessory, is displaced to the location for drilling the next hole, the receptacles can be removed from the receptacle carrier 36 and be suitably identified to permit the required analysis process to be carried out. A further fifteen receptacles are then placed on the receptacle carrier 36 for taking a further fifteen dust particle samples from the next hole to be drilled.

In order to still further facilitate the above operation, the drilling of holes by the drilling apparatus and the operation of the accessory 10 may be effectively synchronized, particularly by providing a control arrangement for the control of the operation of the drilling apparatus and the accessory, which may include a suitable programmed logic controller that can facilitate this. The programmed logic controller may be a suitable computer that is operatively linked with a control arrangement which provides for controlling the various displacement means associated with the accessory 10, thus providing for the required operation of the dust particle catcher 40 and the receptacle carrier 36 in conjunction with the drilling of a hole by the drilling apparatus. It must be understood that the technology required for controlling the operation of the accessory 10 in conjunction with the operation of a drilling apparatus constitutes state-of-the-art technology and, as such, this is not described in any further detail herein.

In order to facilitate the identification of receptacles 44 within which dust particle samples are received, it is proposed to utilize known RFID technology, either by associating each receptacle with a RFID tag that can have required information imparted thereto as part of the process of taking dust particle samples. The RFID tags carried by the receptacles can then be effectively read as part of the dust particle analysis process, thus to provide an accurate estimate of mineral content at the different depths of a particular hole having been drilled and from which samples have been taken. An alternative identification method may include providing a RFID tag feeder as part of the accessory 10, the tag feeder (not shown) being located on the accessory and carrying a plurality of RFID tags that will consecutively be dropped into receptacles 44, each tag carrying required information in respect of the location of a particular hole drilled and the depth segment of the hole with which the dust particle sample is associated. The feeder clearly will include suitable means for transferring required information to the tags, so that this information can be read at the stage of dust particle sample analysis to operatively link the results of the analysis with particular holes and the depth segments of such holes from which the samples were taken. Once again, insofar as RFID technology as envisaged is already well known, this is not described in further detail herein.

The invention accordingly extends also to a method of taking dust particle samples, in association with ground areas being drilled for open cast mining purposes as described, and also to all such variations in the method as can be envisaged.

Still further, insofar as the accessory of the invention can form a part of a drilling apparatus, the invention extends also to such a drilling apparatus that includes an accessory as part thereof.

It must be understood that the mode of operation of the accessory 10 is greatly variable, the support structure 30 typically permitting rotation about the longitudinal axis defined by the piston/cylinder mechanism 32 which, it will be understood, provides for displacement of the dust particle catcher 40 into an alternative location that can serve as a discharge location where the discharge of a dust particle sample into a receptacle can occur. As such, the accessory can be associated with different configuration receptacle carriers that can carry receptacles for receiving dust particle samples.

Figure 4:
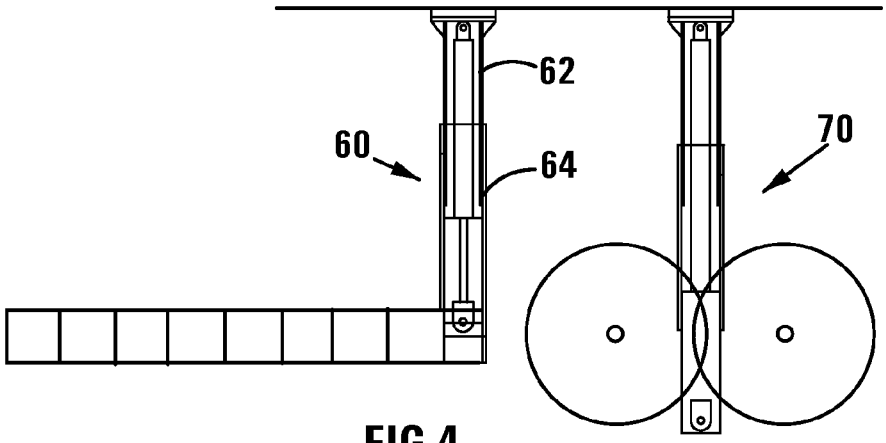
FIG. 4 illustrates schematically in end view a second embodiment of an accessory for use with a drilling apparatus, in accordance with the invention, in a first operative configuration thereof.
Figure 5:
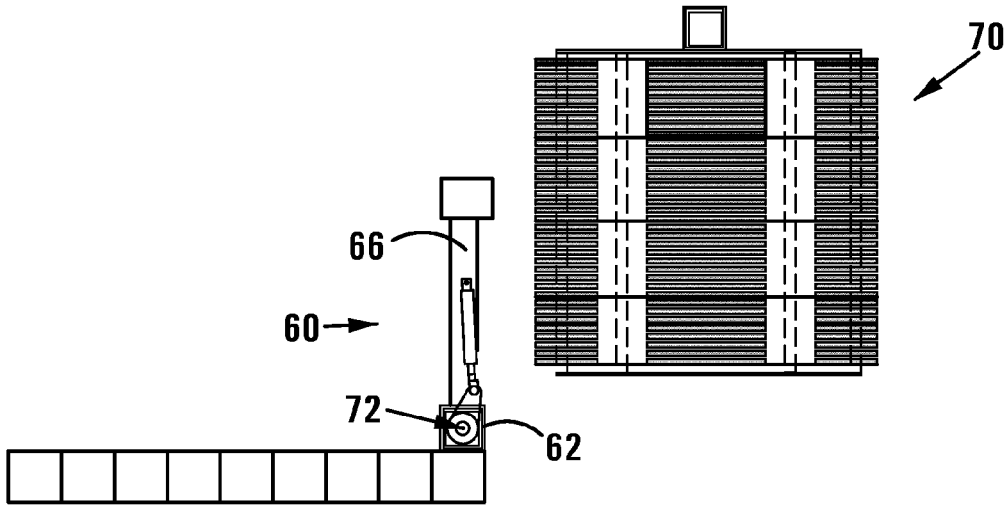
FIG. 5 illustrates in plan view the accessory of FIG. 4, in its first operative configuration.
Figure 6:
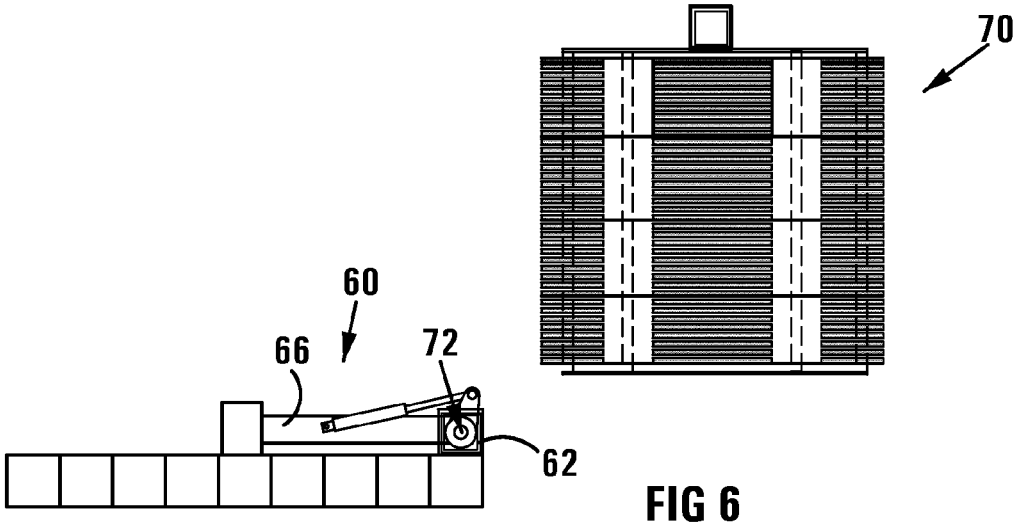
FIG. 6 illustrates in plan view the accessory of FIG. 4, in a second operative configuration thereof.

Referring particularly to FIGS. 4 to 6 of the drawings, there is shown a second embodiment accessory for use with a drilling apparatus, designated generally by the reference numeral 60. The accessory 60 again includes a support structure 62 including a piston/cylinder mechanism 64 which can displace a dust particle catcher 66 between an inoperative configuration, in which it is closely spaced beneath the deck of the associated drilling apparatus, and an operative configuration as shown in FIG. 4, in which the dust particle catcher is located to catch dust particles therein. As is apparent from FIGS. 4 to 6 of the drawings, the dust particle catcher particularly is located adjacent a brush arrangement 70, the dust particle catcher in this case being pivotally displaceable about an axis 72 between its operative configuration as shown in FIG. 5 and a discharge location as shown in FIG. 6, in which the dust particle catcher can discharge a dust particle sample into a receptacle of a receptacle carrier 74 (only shown schematically). Each receptacle of the receptacle carrier can be alternately displaced to receive a dust particle sample therein, in response to the operation of the dust particle catcher.

Many different configuration accessories also are envisaged, it being envisaged that the accessory of the invention will be adapted for particular mining or other applications to accommodate particulate requirements in relation to the collection of dust particle samples and their transfer into receptacles for analysis purposes. The invention extends also to all such variations of accessories which still incorporate the essential principles of the invention as herein defined.

The use of the accessory of the invention will greatly facilitate the taking of dust particle samples for the applications envisaged, particularly also the identification of samples taken. Analysis may thus be associated with the use of software programs that will link analysis results with holes drilled and that can hence provide for improved analysis results associated with the entire area within which holes have been drilled.

The invention claimed is:

1. An accessory for use with a drilling apparatus, which includes an accessory support structure that can be mounted on the support structure of a drilling apparatus in a location where it is exposed to dust particles blown from a hole drilled by the drilling apparatus, in use of the drilling apparatus; a dust particle catcher mounted on the accessory support structure in a configuration in which, with the accessory support structure mounted on the support structure of a drilling apparatus and during drilling of a hole, it can catch dust particles to form a dust particle sample and discharge the dust particle sample into a receptacle; and a control arrangement that can control the operation of the dust particle catcher for forming dust particle samples representative of depth segments of a hole being drilled by a drilling apparatus on the support structure of which the accessory support structure is operatively mounted.

2. An accessory as claimed in claim 1, in which the accessory support structure is mounted on the deck of the support structure of a drilling apparatus, to be disposed operatively beneath the deck.

3. An accessory as claimed in claim 2, which includes a first displacement means for displacing the position of the dust particle catcher mounted on the accessory support structure, with the accessory support structure mounted on the deck of the support structure of a drilling apparatus, between an operative configuration, in which it can catch dust particles, and an inoperative configuration, in which it is closely spaced beneath the deck of the support structure of the drilling apparatus.

4. An accessory as claimed in claim 3, in which the control arrangement controls the operation of the first displacement means.

5. An accessory as claimed in claim 1, in which the dust particle catcher includes a vessel formation that is pivotally displaceable between a catching configuration, in which it can catch dust particles thereon for forming a dust particle sample, and a discharge configuration, in which a dust particle sample is displaced from the vessel formation into a receptacle.

6. An accessory as claimed in claim 5, which includes a second displacement means for pivotally displacing the vessel formation of the dust particle catcher between its catching configuration and its discharge configuration.

7. An accessory as claimed in claim 6, in which the control arrangement controls the operation of the second displacement means.

8. An accessory as claimed in claim 5, in which the vessel formation of the dust particle catcher is displaceable from a first location, where it is disposed in its catching configuration and in a location where it can catch dust particles for forming a dust particle sample, and a second location displaced from the first location, where it is displaceable into its discharge configuration for discharging a dust particle sample into a receptacle.

9. An accessory as claimed in claim 8, which includes a third displacement means for displacing the vessel formation of the dust particle catcher between its first location and its second location.

10. An accessory as claimed in claim 9, in which the control arrangement controls the operation of the third displacement means.

11. An accessory as claimed in claim 1, which includes a receptacle carrier mounted on the accessory support structure and that is configured to carry at least one receptacle in a location where it can receive a dust particle sample caught by the dust particle catcher.

12. An accessory as claimed in claim 11, in which the receptacle carrier can removably carry a plurality of receptacles and in which the carrier is displaceable with respect to the accessory support structure in a configuration in which receptacles carried thereby are alternately disposed in a position with respect to the dust particle catcher to receive a dust particle sample therefrom.

13. An accessory as claimed in claim 12, in which the receptacle carrier comprises a rotatable carousel-type structure that removably carries a plurality of receptacles and that, through rotation, alternately displaces a different receptacle carried thereby into a position in which it can receive a dust particle sample therein from the dust particle catcher.

14. An accessory as claimed in claim 12, which includes a fourth displacement means for displacing the receptacle carrier with respect to the support structure between positions in which receptacles carried thereby are alternately positioned with respect to the dust particle catcher to receive a dust particle sample therein.

15. An accessory as claimed in claim 14, in which the control arrangement controls the operation of the fourth displacement means.

16. An accessory as claimed in claim 12, which includes receptacles to be removably carried by the receptacle carrier and in which the receptacles comprise any one of receptacle bags and bottles, that can be closed for containing dust particle samples therein.

17. An accessory as claimed in claim 1, in which the control arrangement, in use of the accessory, is operatively linked with a programmed logic controller that is programmed to facilitate the identification of dust particle samples collected in receptacles in terms of particular holes drilled from which the samples are collected and the depth ranges of each particular hole drilled, from which samples are collected.

18. An accessory as claimed in claim 17, in which the control arrangement is operatively linked with a programmed logic controller that forms a part of the accessory.

19. An accessory as claimed in claim 17, in which the programmed logic controller is operatively linked with the drilling apparatus with which the accessory of the invention is operatively associated for facilitating the operation of the accessory in terms of taking dust particle samples in response to the actual drilling of a hole in the ground.

20. An accessory as claimed in claim 1, which includes sample identifier means for identifying dust particle samples taken by the accessory.

21. An accessory as claimed in claim 20, in which the sample identifier means is configured to utilize RFID technology, each receptacle for receiving a dust particle sample during use of the accessory carrying a RFID tag to which required information is transferred for identifying the location of a hole and the depth range of the hole, from which a dust particle sample has been taken and received in the receptacle.

22. An accessory as claimed in claim 1, which includes a RFID feeder device for feeding RFID tags into receptacles in which dust particle samples are collected, in use of the accessory, the feeder device serving also to transfer required information to the memories of the RFID tags for identifying the location of a hole being drilled and the depth segment of the hole from which a dust particle sample has been taken.

23. A drilling apparatus that is adapted for use with an accessory as claimed in claim 1.

24. A drilling apparatus which includes an accessory, as claimed in claim 1, as part thereof.

* * * * *